US010888137B2

(12) United States Patent
Izquieta Anaut

(10) Patent No.: US 10,888,137 B2
(45) Date of Patent: Jan. 12, 2021

(54) FOOTWEAR SOLE

(71) Applicant: Desarrollo Integral del Molde, S.L., Navarra (ES)

(72) Inventor: Jose M. Izquieta Anaut, Navarra (ES)

( * ) Notice: Subject to any disclaimer, the term of this patent is extended or adjusted under 35 U.S.C. 154(b) by 27 days.

(21) Appl. No.: 16/482,534

(22) PCT Filed: Mar. 17, 2017

(86) PCT No.: PCT/ES2017/070155
§ 371 (c)(1),
(2) Date: Jul. 31, 2019

(87) PCT Pub. No.: WO2018/167331
PCT Pub. Date: Sep. 20, 2018

(65) Prior Publication Data

US 2020/0085139 A1 Mar. 19, 2020

(51) Int. Cl.
*A43B 13/18* (2006.01)
*A43B 7/14* (2006.01)

(52) U.S. Cl.
CPC ..... *A43B 13/181* (2013.01); *A43B 7/146* (2013.01); *A43B 13/18* (2013.01)

(58) Field of Classification Search
CPC ..... A43B 7/146; A43B 13/18; A43B 13/181
USPC ..... 36/25 R, 28, 141
See application file for complete search history.

(56) References Cited

U.S. PATENT DOCUMENTS 4,934,070 A * 6/1990 Mauger ..... A43B 17/035 36/28
5,189,816 A * 3/1993 Shibata ..... A43B 13/20 36/28
5,365,678 A * 11/1994 Shibata ..... A43B 13/20 36/141
5,768,806 A * 6/1998 Parisotto ..... A43B 21/32 36/103
5,815,949 A 10/1998 Sessa
5,839,208 A * 11/1998 Huang ..... A43B 13/186 36/28
5,918,385 A * 7/1999 Sessa ..... A43B 13/223 36/25 R (Continued)

FOREIGN PATENT DOCUMENTS

EP 0185781 A1 7/1986
EP 3047964 A1 7/2016
GB 2152797 A 8/1985

*Primary Examiner* — Marie D Bays
(74) *Attorney, Agent, or Firm* — Albert Bordas, P. A.

(57) ABSTRACT

Sole for footwear that includes configurations that improve the cushioning in a user's tread with respect to known soles, comprising a lower layer and a side wall, the lower layer comprising a front part, a middle part and a rear part; in at least one portion of the front or rear part of the lower layer there are at least two protrusions, each arranged and extended transversely to the longitudinal axis of the sole and each of them comprising a first segment in contact with the lower tread and a second segment; between the side ends of each protrusion and the side wall there is a first separation that allows the full bending of each protrusion, the second segment being inclined with respect to the first segment; between two adjacent protrusions there is a second separation so that the second segment rests at least partly on the adjacent protrusion.

3 Claims, 2 Drawing Sheets

(56) References Cited

U.S. PATENT DOCUMENTS

| | | | | |
|---|---|---|---|---|
| 6,367,174 | B1 * | 4/2002 | Shibata | A43B 7/144 36/141 |
| 6,625,902 | B2 * | 9/2003 | Yamamoto | A43B 7/08 36/102 |
| 7,281,343 | B2 * | 10/2007 | Riha | A43B 13/141 36/103 |
| 2011/0167672 | A1 * | 7/2011 | Bond | A43B 13/223 36/28 |
| 2011/0308106 | A1 * | 12/2011 | Lim | A43B 7/1435 36/28 |
| 2012/0005921 | A1 * | 1/2012 | Diepenbrock | A43B 7/144 36/28 |
| 2012/0174439 | A1 | 7/2012 | O'Connor | |
| 2013/0000157 | A1 * | 1/2013 | Wu | A43B 9/00 36/30 A |
| 2016/0128423 | A1 * | 5/2016 | Shibata | A43B 13/386 36/28 |
| 2016/0219974 | A1 * | 8/2016 | Izquieta Anaut | B29D 35/122 |
| 2020/0170336 | A1 * | 6/2020 | Lucca | A43B 7/142 |

* cited by examiner

FOOTWEAR SOLE

FIELD OF THE INVENTION

The present invention lies within the field of soles for footwear, and in particular those that include configurations that improve cushioning of the tread.

BACKGROUND OF THE INVENTION

Shoe soles are known which include configurations protruding from the lower layer of the sole upwards to serve as cushioning for the tread.

Some known configurations are arranged perpendicularly to the lower layer of the sole, such as conical frustums or hemispheres, which makes them suitable for large efforts or heavy users, i.e., they cushion large loads, so for normal use they have no effect and become uncomfortable. There are also known slat-type configurations in which the slats are arranged at an inclination with respect to the lower layer of the sole, which, although more comfortable than the previous ones, are only suitable for withstanding large and medium loads, which also makes them uncomfortable.

DESCRIPTION OF THE INVENTION

This invention is established and characterised in the independent claims, while the dependent claims describe other features thereof.

The object of the invention is a sole for footwear that includes configurations that improve the cushioning in a user's tread with respect to known soles. The technical problem addressed is how to configure the sole in order to achieve the aforementioned object.

In view of the above, the present invention relates to a sole for footwear comprising a lower layer and a side wall along the perimeter of the lower layer. As a way of locating the various usual areas with respect to the position of the sole on footwear worn by a user, the lower layer comprises a front part corresponding to the front area of a user's foot, a middle part corresponding to the middle area of a user's foot and a rear part corresponding to the rear area of a user's foot. In at least one portion of the front or rear part of the lower layer, there are at least two protrusions, each arranged and extended transversely to the longitudinal axis of the sole. Each of the protrusions comprises a first segment in contact with the lower layer and a second segment following the first segment.

The sole is characterised in that between the side ends of each protrusion and the side wall there is a first separation that allows each protrusion to fully bend, i.e., since its movement is not restricted by the sides, it can move freely. The second segment is arranged inclined with respect to the first segment, between two adjacent protrusions there is a second separation so that when said protrusions flex when supporting a user's foot, the second segment is supported at least in part on the adjacent protrusion; this creates a joint cushioning effect of the protrusions as one of them serves as support to the adjacent one. Thus, its effect is the result of the joint action, they do not act individually and a sole in which they did would have a very different effect from that explained herein.

This effect is optimal when in the front part of the lower layer the inclination of the second segment of each protrusion is directed towards the front end of the sole, in the rear part of the lower tread the inclination of the second segment of each protrusion is directed towards said rear part of the sole.

As a result of the protrusions flexing after treading, there is an increase of the interior space in the sole, specific to each foot, adjusting exactly to the shape, size and even defects, even for the different feet of a single user, so that a custom-made sole is achieved.

The arrangement and separation between the slats is such that it does not allow the use of a tool for machining the mould of the sole, but requires the use of different processes such as 3D printing.

The number of protrusions depends on the desired use, since sports footwear is different from street footwear, as is men's from women's. In this regard, their arrangement in one area or another of the sole also depends on the use; for example, high-heeled women's footwear has no space in the rear area for any protrusions, and these are only arranged in the front area.

In short, there is no known precedent for a sole as claimed, which makes it unique in terms of comfort and comprehensive manufacturing by moulding, in a single piece, without the need to incorporate any added element after its manufacture, whereby the sole is more economical.

Other advantages related with the features of the dependent claims are indicated in the detailed explanation.

BRIEF DESCRIPTION OF THE FIGURES

This specification is supplemented by a set of drawings illustrating the preferred embodiment but which are never intended to limit the invention.

DETAILED DESCRIPTION OF THE INVENTION

An embodiment of the invention is described below with reference to the figures.

Figure 1:
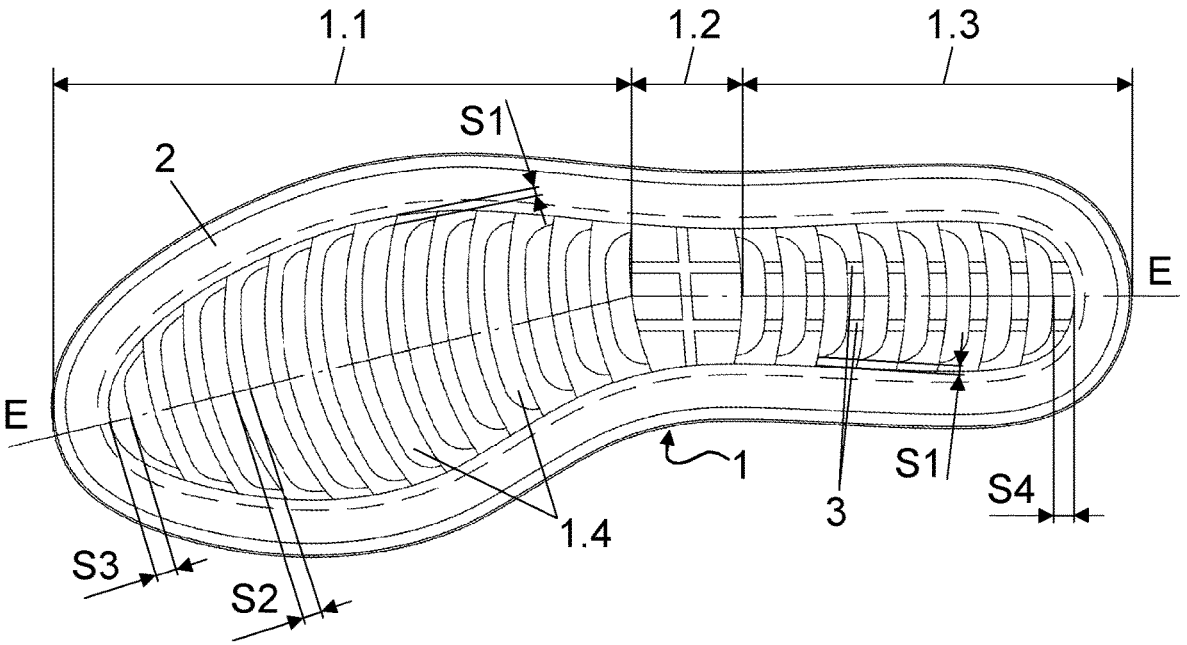
FIG. 1 shows a plan view of the sole.
Figure 3:
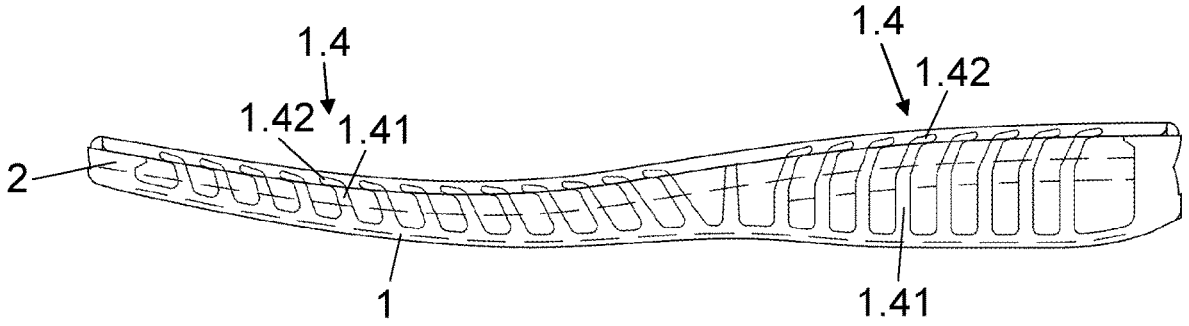
FIG. 3 shows a longitudinal section of the sole.
Figure 4:
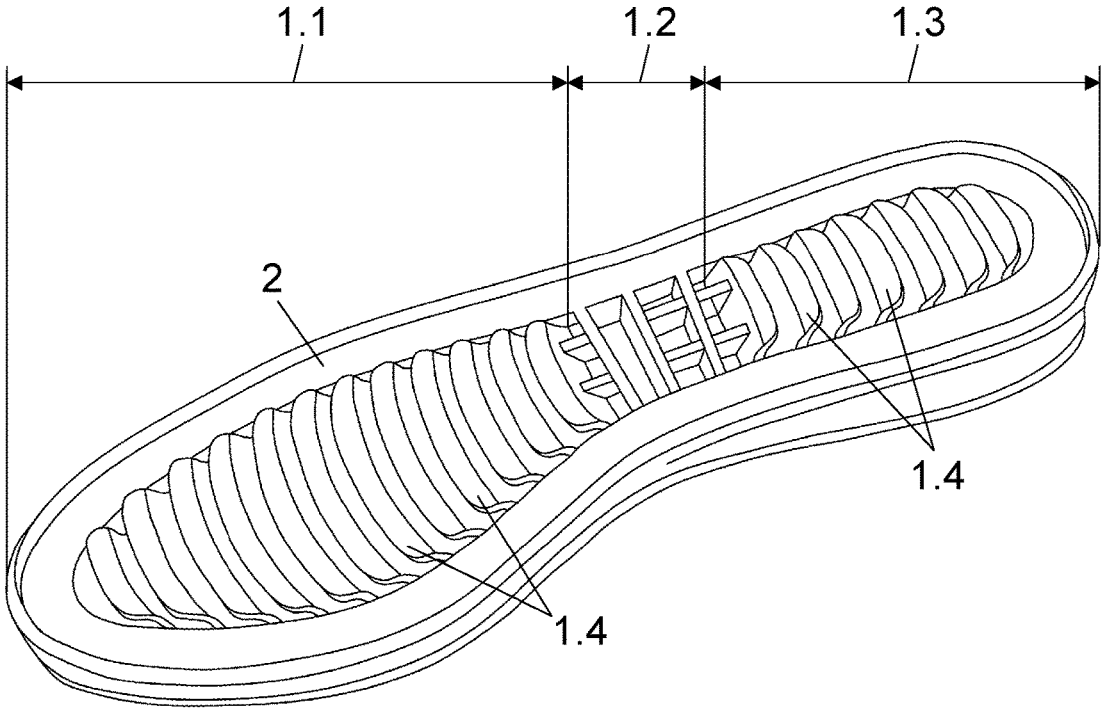
FIG. 4 shows a perspective view of the sole.

FIGS. 1 and 3 show a sole for footwear comprising a lower layer (1) and a side wall (2) along the perimeter of the lower layer, the lower layer (1) comprising a front part (1.1) corresponding to the front area of a user's foot, a middle part (1.2) corresponding to the middle area of a user's foot and a rear part (1.3) corresponding to the rear area of a user's foot, in at least one portion of the front (1.1) or rear part (1.3) of the lower layer (1) there are at least two protrusions (1.4); the figures show 13 in the front part (1.1) and 8 in the rear part (1.3), but their number will depend on the sole size as well as the intended cushioning.

Each protrusion (1.4) is arranged and extended transversely to the longitudinal axis (E) of the sole, the longitudinal axis being understood as that running from one end of the sole to the other and through its middle part, even if it involves some change of direction as shown in FIG. 1.

As seen in FIG. 3, each protrusion (1.4) comprises a first segment (1.41) in contact with the lower layer (1) and a second segment (1.42) following the first segment (1.41). As shown in FIG. 3, some of them may vary depending on their length, for example, the one shown has two sections, it can be considered as a third segment between the first (1.41) and the second (1.42), although this is only one representation because it could be that the first segment (1.41) is curved and has only one section.

Between the side ends of each protrusion (1.4) and the side wall (2) there is a first separation (S1), shown in FIG. 1, which allows the full bending of each protrusion (1.4), the second segment (1.42) being arranged inclined with respect to the first segment (1.41); between two adjacent protrusions (1.4) there is a second separation (S2), shown in FIG. 1, so that when said protrusions (1.4) flex when supporting a user's foot, the second segment (1.42) rests at least partly on the adjacent protrusion (1.4); in the front part (1.1) of the lower layer (1), the inclination of the second segment (1.42) is directed towards the front end of the sole, while in the rear part (1.3) of the lower layer (1) the inclination of the second segment (1.42) is directed towards said rear part of the sole.

The conjunction of these configurations is what provides the sole with a particular cushioning that is different from what is known. The specific dimensions depend on each use and in combination with the material that is used among those usual for soles: rubber, thermoplastic polyurethane (TPU), etc. The combination of dimensions, with material, with the claimed configurations gives rise to an intended cushioning, which will depend on each case.

One option is that between the side wall (2) and the first protrusion (1.4) from the front part (1.1) there is a third separation (S3), shown in FIG. 1, so that when said protrusion (1.4) flexes when supporting a user's foot, the second segment (1.42) is supported at least partly on the side wall (2). Similarly, between the side wall (2) and the first protrusion (1.4) from the rear part (1.3) there is a fourth separation (S4), shown in FIG. 1, so that when said protrusion (1.4) flexes when supporting a user's foot, the second segment (1.42) is supported at least partly on the side wall (2). In this way, the effect between protrusions (1.4) is repeated when one of them is the first from each end of the sole, whereby the whole assembly of protrusions (1.4) behaves similarly.

Figure 2:
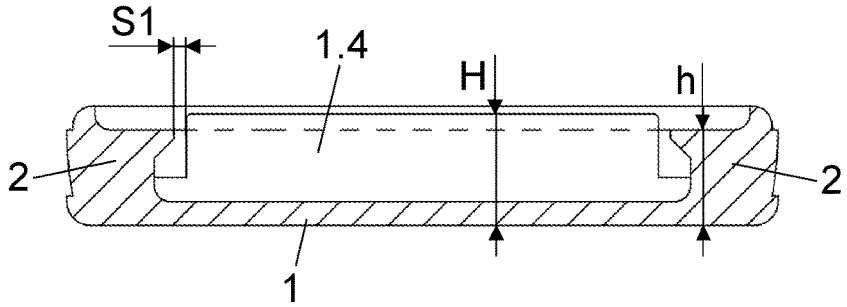
FIG. 2 shows a cross-sectional view of the sole.

Another option is that the height (H) of the protrusions (1.4) is greater than the height (h) of the side wall (2), shown in FIG. 2. Although it may be less or equal, the cushioning is improved when it is greater because the protrusions (1.4) act on the user's foot before any other configuration.

Another option is that two adjacent protrusions (1.4) are joined by at least one partition (3), shown in FIG. 1, arranged transversely to said protrusions (1.4) and its height being equal to or less than that of the latter. This configuration provides rigidity to the assembly and although it can be arranged both in the front part (1.1) and in the rear part (1.3), it is more usual in the latter, where the user's heel is located and therefore with the highest loads during the tread.

Also, other similar partitions can be arranged in the middle part (1.2) as shown in FIGS. 1 and 3 without numerical reference. These other partitions have no other mission than that of providing continuity to the configurations of the sole and in a very limited way they provide some cushioning although in that area the loads in the tread are minimal.

The invention claimed is:

1. Sole for footwear comprising a lower layer (1) and a side wall (2) along the perimeter of the lower layer, the lower layer (1) comprising a front part (1.1) corresponding to the front area of a user's foot, a middle part (1.2) corresponding to the middle area of a user's foot and a rear part (1.3) corresponding to the rear area of a user's foot, in at least a portion of the front (1.1) or rear part (1.3) of the lower layer (1) there are at least two protrusions (1.4), each arranged and extended transversely to the longitudinal axis (E) of the sole and each of them comprising a first segment (1.41) in contact with the lower layer (1) and a second segment (1.42) following the first segment (1.41), characterized in that there is a first separation (51) between the side ends of each protrusion (1.4) and the side wall (2) that allows the full bending of each protrusion (1.4), the second segment (1.42) is arranged inclined with respect to the first segment (1.41); between two adjacent protrusions (1.4) there is a second separation (S2) so that when said protrusions (1.4) flex when supporting a user's foot, the second segment (1.42) is supported at least partly on the adjacent protrusion (1.4); in the front part (1.1) of the lower layer (1) the inclination of the second segment (1.42) is directed towards the front end of the sole, while in the rear part (1.3) of the lower tread (1) the inclination of the second segment (1.42) is directed towards said rear part of the sole;

between the side wall (2) and the first protrusion (1.4) from the front part (1.1) there is a third separation (S3) so that when said protrusion (1.4) flexes when supporting a user's foot, the second segment (1.42) rests at least partly on the side wall (2); and between the side wall (2) and the first protrusion (1.4) from the rear part (1.3) there is a fourth separation (S4) so that when said protrusion (1.4) flexes when supporting a user's foot, the second segment (1.42) rests at least partly on the side wall (2).

2. The sole according to claim 1, wherein the height (H) of the protrusions (1.4) is greater than the height (h) of the side wall (2).

3. The sole according to claim 1, wherein two adjacent protrusions (1.4) are joined by at least one partition (3) arranged transversely to said protrusions (1.4) and its height being equal to or less than that of the latter.

* * * * *